United States Patent [19]

Sanfeliu-Marimon

[11] 4,390,302

[45] Jun. 28, 1983

[54] FRAMEWORK FOR FIXEDLY SUPPORTING A HORIZONTAL ARM

[75] Inventor: Jaime Sanfeliu-Marimon, Barcelona, Spain

[73] Assignee: Storage Systems and Industrial Products Ltd., Zurich, Switzerland

[21] Appl. No.: 231,443

[22] Filed: Feb. 4, 1981

[30] Foreign Application Priority Data

Feb. 5, 1980 [ES] Spain ..... 488925

[51] Int. Cl.[3] ..... F16B 7/08; F16B 9/00

[52] U.S. Cl. ..... 403/187; 403/379; 248/240; 211/187

[58] Field of Search ..... 403/379, 187, 191, 374, 403/83, 161; 248/240, 243; 211/187

[56] References Cited

U.S. PATENT DOCUMENTS

| | | | |
|---|---|---|---|
| 3,484,125 | 12/1969 | Randour | 403/379 X |
| 3,512,654 | 5/1970 | Olsen et al. | 248/243 X |
| 4,029,355 | 6/1977 | Wilhelmsen | 248/240 X |
| 4,139,247 | 2/1979 | Karashima | 211/187 X |

*Primary Examiner*—Wayne L. Shedd

*Attorney, Agent, or Firm*—Cushman, Darby & Cushman

[57] ABSTRACT

A framework for supporting a horizontal arm at one of a plurality of locations from a vertically extending member having a plurality of vertically separated openings, each of which can be aligned with a similar opening in one end of the arm. A pair of triangular section cotter pins extend through the aligned openings with the hypotenuses in contact and the other two dimensions being less than the corresponding opening dimension so that after pin insertion, downward movement of the arm, misaligning the opening, locks the arm to the member.

3 Claims, 4 Drawing Figures

2
5
1
7
3
8
6
2
5
4
2
5
10

2
7
8
9
6
5
3

4
8
1
10

3
9
2
8
6

FRAMEWORK FOR FIXEDLY SUPPORTING A HORIZONTAL ARM

BACKGROUND AND SUMMARY OF THE INVENTION

The present invention refers to improvements in framework for mounting portable arms on vertical members, of the type which comprise some few vertical mountings preferably braced, over the which are disposed some few portable arms horizontal in projection, capable of being immovably fixed at a desired height, the mountings in practice carrying some apertures adapted to interface with support elements disposed on an end of the portable arms.

There are already known mountings which present vertical threads aligned to inclined openings of rectangular form, adapted to receive unique cotter pins formed rectangularly in transverse section. In such cases, the rectangular form of the cotter pin contacts surfaces of the apertures of the mountings which are small enough to give rise to elevated forces above the edges of the openings of the mountings and of the supporting elements which produce deformations.

According to the present invention, a framework is provided for fixedly supporting a horizontal arm at one of a plurality of locations from the vertically extending member. The vertically extending member is provided with a plurality of separated rectangular openings, each of which can be aligned with a similar opening on one end of a horizontal arm. The arm can be locked to the vertically extending member by insertion of a pair of cotter pins of right triangular section through the aligned openings with the hypotenuses of the triangular sections being in contact. The other dimensions of the triangular section are less than the corresponding dimensions of the openings so that after insertion of the pins through the opening, downward movement of the arm misaligns the openings and locks the arms to the member.

Other characteristics and advantages of the improvements in the system of fixation of the movable arms on vertical mountings which are treated will become apparent from the following description taken in relation to the attached drawings which illustrate, by way of example and not of limitation, an embodiment of the present invention.

Figure 1:
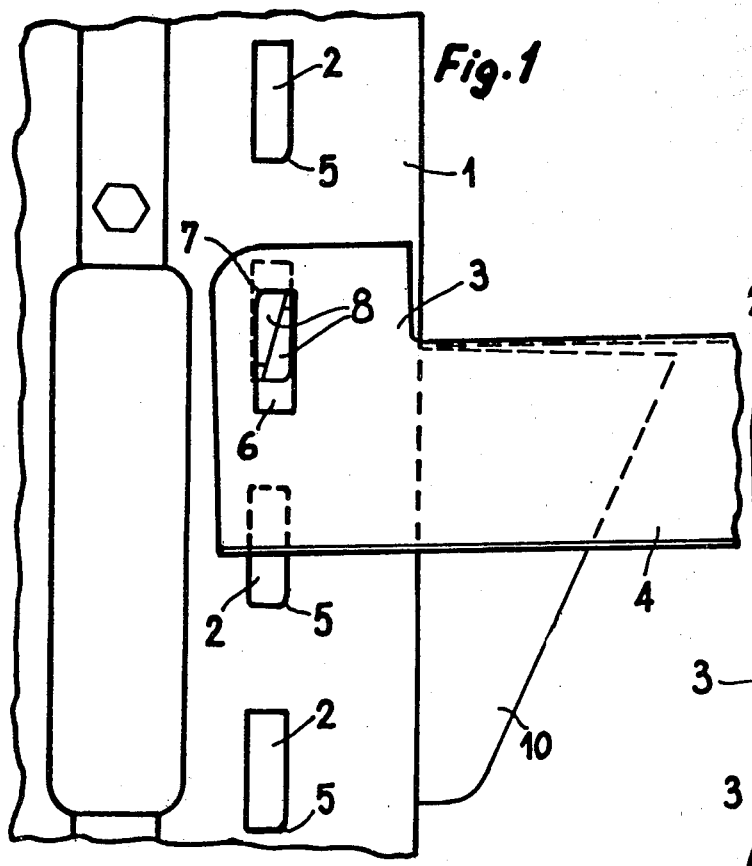
FIG. 1 is a side elevational view of a detail of the joining of a portable horizontal arm in projection above a vertical mounting, according to the improvements which are the object of the present invention.

In the drawings it is appreciated that the mounting 1 has apertures 2 which can be aligned with similar apertures of support 3 which are disposed on an end of arm 4.

DETAILED DESCRIPTION OF THE DRAWINGS

Figure 4:
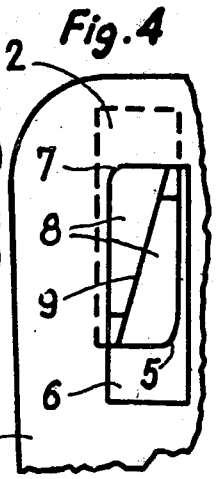
FIGS. 3 and 4 show, on a blown-up scale, the disposition of the cotter pins in the orifices of the mountings and of the elements of support disposed in the portable arms, at the moment of introduction and in the position after insertion, respectively.
Figure 2:
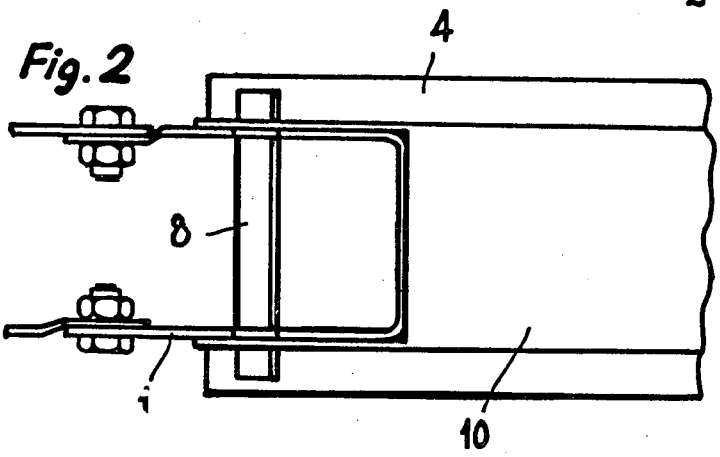
FIG. 2 is a bottom view of the detail of FIG. 1.
Figure 3:
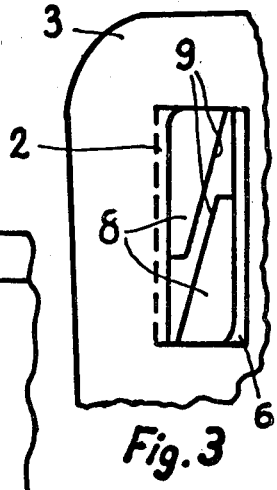

The vertical member 1 is provided with a plurality of pairs of substantially rectangular openings 2 having a longer vertical than horizontal direction. The lower corner of each opening is rounded as shown. One end 3 of horizontal arm 4 is provided with a similar pair of openings 7 which match and can be aligned with any of the pairs of openings 2. When the openings of end 3 and member 1 are aligned, a pair of cotter pins 7 and 8 can be inserted through the respective openings. Cotter pins 7 and 8 are preferably identical and formed as right triangles in section with the right angle intersection being rounded to match the rounded lower corner 5 of opening 2. The hypotenuses of the right triangles are in contact and the other dimensions are such that when the openings are aligned the cotter pins can be inserted without difficulty. During insertion, the horizontal arm is manually or otherwise supported with the openings in alignment. When the arm is thereafter released, it moves downward misaligning openings 2 and 7 as shown in FIG. 4 so that the cotter pins firmly and securely lock arm 4 to vertical member 1. The movable arm preferably includes a bracket 10 contacting the vertical member 1 and providing firm support for the arm.

Many changes and modifications in the abovedescribed embodiment, can, of course, be carried out without departing from the scope of the present invention, that scope intended to be limited only by the scope of the appended claims.

What is claimed is:

1. A framework including a generally vertically extending elongated member for fixedly supporting a substantially horizontally extending arm from a transversely extending member at one of a plurality of locations comprising:

an extending member having a plurality of longitudinally separated rectangular openings;

an arm extending transversely to said member and having a rectangular opening aligned with one of the openings of said vertical member; and a pair of cotter pins of right triangular cross section extending through said one opening and one of said openings of said member, said pins being in contact along the hypotenuses of the triangular sections and having dimensions along the other two sides less than the corresponding dimensions of said openings whereby after insertion of said pins through said openings said arm moves downward by gravity misaligning said openings by forcing said triangular members toward a superposed position in which they are wedged against each other and the surrounding surfaces of the openings and lock said arm to said member.

2. A framework as in claim 1, wherein said openings have a longer vertical than horizontal dimension.

3. A framework as in claim 1 or 2, wherein said member has aligned transversely spaced pairs of openings and said arm has an aligned pair of openings with said pins extending through all said pairs.

* * * * *